United States Patent [19]

Schramm

[11] 4,181,485

[45] Jan. 1, 1980

[54] TILTABLE MOLD AND SHED MEANS

[76] Inventor: Horst Schramm, Schellingstr. 16, D-6000 Frankfurt am Main, Fed. Rep. of Germany

[21] Appl. No.: 851,420

[22] Filed: Nov. 14, 1977

[51] Int. Cl.[2] ..... B28B 7/08

[52] U.S. Cl. ..... 425/88; 249/137; 425/422; 425/439; 425/441; 425/454

[58] Field of Search ..... 249/137; 425/88, 439, 425/453, 454, 422, 441

[56] References Cited

U.S. PATENT DOCUMENTS

| | | | |
|---|---|---|---|
| 3,640,658 | 2/1972 | Price | 249/137 |
| 3,732,052 | 5/1973 | Gunia | 425/88 |
| 3,827,666 | 8/1974 | Dreher | 249/137 |
| 4,077,757 | 3/1978 | DeCoster | 249/137 |

*Primary Examiner*—John McQuade

*Attorney, Agent, or Firm*—Hill, Van Santen, Steadman, Chiara & Simpson

[57] ABSTRACT

Method and apparatus for the manufacture of pre-cast plate-like concrete elements on a building site. A horizontal casting table has a large area mold into which the concrete is poured. After a short setting time to allow the concrete to harden, the table is raised to a vertical position and the partially hardened concrete element is drawn off of the mold. The process of moving the table to a vertical condition is accompanied by a lateral movement such that the latest element is stacked at the head of a line of previously cast elements. The elements are allowed to stand undisturbed until hardening is complete. Casting is done in a movable shed which shelters the partially hardened elements from the weather. Ribbed elements may be cast using a further mold element raised and lowered from the ceiling of the shed.

10 Claims, 5 Drawing Figures

TILTABLE MOLD AND SHED MEANS

BACKGROUND OF THE INVENTION

The invention lies in the field concerning the manufacture of pre-cast concrete elements.

Large-area wall and ceiling elements of very smooth concrete can play a substantial role in the long-overdue rationalization and modernization in housing construction. In contrast to conventional masonry these elements have the advantage of being able to serve simultaneously as heat transfer elements andcanals for ventilation, heating and installations. As opposed to lightweight constructions, they have the advantage of ensuring better sound-proofing, heat retention and refractoriness, as well as greater durability.

For interior walls, particularly dividing walls in houses or flats, the elements are constructed as ribbed walls. Two ribbed walls are so positioned in each case that their ribs interlock. The ribs can be chosen to be so strong as to act as supporting component parts. Continuous hollow spaces occur between the ribs, which can be made use of for heating and installation purposes.

For the outer walls, the elements are constructed as highly-insulating, two-sheet component parts, this being done in several consecutive stages whereby an element is produced consisting of a ribbed wall, between whose ribs a very strong insulation layer of hard-foam plates is embedded, projecting above the ribs. The front edges of the ribs are also insulated. Finally with the help of slots provided in the hard-foam plates, a facing of cement mortar with pre-determined breaking points is poured over. Between the hard-foam insulation and the ribbed wall, hollow spaces are provided which can be used as air-circulation canals and which separate the facing and the ribbed wall acoustically from one another in such a way that the element becomes a two-sheet wall. All these working stages are carried out according to the invention on a special horizontal table. After a short setting time the table and element are raised, the element placed in a vertical position, and the table brought back to its horizontal position so that the next element can be concreted. The elements stacked vertically do not require any further special support. They are left standing until they have achieved their full rigidity.

SUMMARY OF THE INVENTION

The invention provides an arrangement for the production of pre-cast plate-like concrete elements by casting on a casting table provided on its surface with a large-area mold, particularly on the building site, characterized in that after a short setting time for the concrete, the concrete elements together with the casting table are raised by rolling away the table on curved runners reaching to the front edges of the table, and in that the concrete elements in the raised position are drawn off from the large-area mold and are stored in the position thus assumed.

One advantage of this method lies in that a small specialized operating force with little expenditure on apparatus can manufacture all necessary elements for a building project and that the excavation need only be started after completion and hardening of all elements; with the help of a mobile crane the building can then be put up in a few days. In this way the costs for machinery being used are kept to a minimum.

The method is preferably further characterized in that the runners of the casting table are circularly curved and that the centre of curvature lies at the centre of gravity of the concrete element. When drawing off the concrete element from the large-area mold, the casting table is pushed back in relation to this by at least the breadth of the element to be subsequently concreted. At the same time a shed according to the invention is pushed back by at least the breadth of the following element. The mold inserts necessary for the production of ribbed walls according to the invention are jointed into a grillage which is hung from the ceiling of the shed and by means of a winch is drawn off from the ribbed wall and either raised to the ceiling or lowered respectively. The cable being driven by the winch according to the invention is led over rollers in such a way that the raising and lowering respectively of the casting table can also be effected by means of this winch.

To facilitate putting the method into practice, the invention provides for a casting table for the casting of plate-like concrete elements according to the invention, the casting table standing on sled-like understructures which enable it to be rolled away and thus raised into a vertical position on the understructures. The runners for the casting table according to the invention are circularly curved with the centre of curvature lying at the centre of gravity of the element to be concreted. The curvature of the runners is so designed that the moments resulting during lifting and lowering of the table correspond as nearly as possible to a desired pattern of moments. The lowest part of the casting table mold according to the invention consists of a support not being rigidly connected to the rest of the mold framework. The casting table according to the invention is provided with winches, with whose help one can press against the support and thus draw off the casting table.

The invention further provides for winches suitable for use in connection with the above-mentioned casting table, being characterized in that their lift is sufficiently large as to allow the casting table to be pushed further during the withdrawal process immediately into the next concreting position.

In a special embodiment of the invention, the casting table is provided with claws which prevent the concreted element from sliding prematurely off the mold framework during the erection process.

According to a preferable version of the invention, a movable shed is provided, standing on rollers and being moved together with the casting table. The movable shed according to the invention is characterized by having a rod against whose end the casting table pushes when being moved on, so that the shed itself is moved on by the same amount as the table. The movable shed according to the invention is provided further with a winch and a cable being led over rollers, by means of which cable the casting table can be raised. In addition, the ceiling of the movable shed according to the invention has further rollers attached to it over which the cable can be passed so that with the help of the winch further casting elements can be wound up and let down.

DETAILED DESCRIPTION OF THE METHOD AND PREFERRED EMBODIMENT

Figure 1:
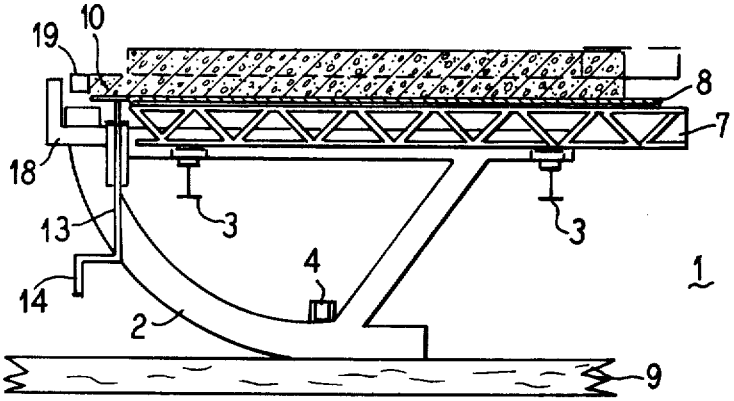
FIG. 1 is a planar side view of the casting table of the present invention.
Figure 2:
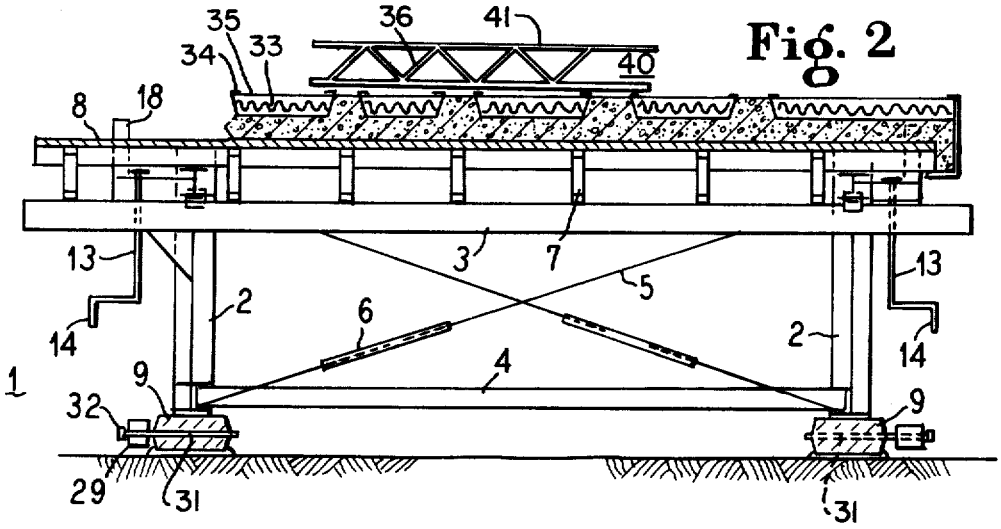
FIG. 2 is a planar end view of the casting table of the present invention.
Figure 3:
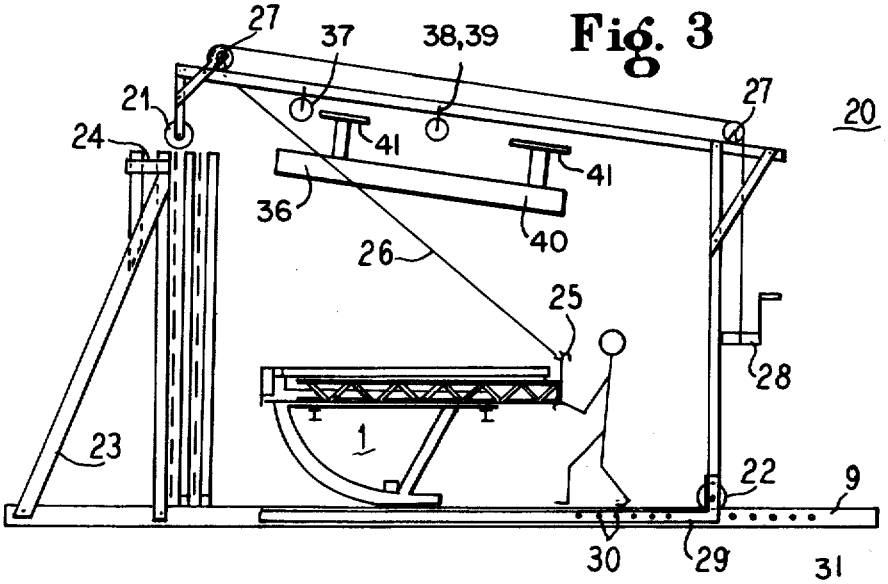
FIG. 3 is a planar side view of the movable shed containing the casting table of the present invention.

By way of example and disclosure of the best mode but without limitation, FIG. 1 generally discloses a side view of the casting table of the present invention.

The casting table 1 stands on two sled-shaped understructures 2, being connected by support 3 and a structural girder 4 which is rigid in all directions. These components are braced to a rigid supporting frame by means of steel cables 5 which are provided with stretching devices 6. The distance between understructures 2 is so chosen that support 3 bends minimally under load.

The supports 7, which can for example be customary wooden mold supports, are attached in cross direction on the supports 3, and the large-area mold 8 is then attached to the support 7. The supports 7 and the mold 8 can be of wood or steel as according to the size of the form being produced. The supporting frame stands with the understructures 2 on strong lengths of squared timber (crane beams, for example) 9, which are laid exactly horizontal and at the same level on the ground. For exact positioning a mortar bed is to be recommended. It is also possible to use some other foundation of adequate rigidity, for example concrete-reinforced slabs or steel supports. The side facing the bent part of the understructure 2 becomes the underside. Support 7 and mold 8 do not reach right to the bottom. The lowest part of the mold is formed by a support 10 running the whole length of the casting table. This support 10 is laid on the supporting frame. It is not rigidly connected to the rest of the mold.

Figure 4:
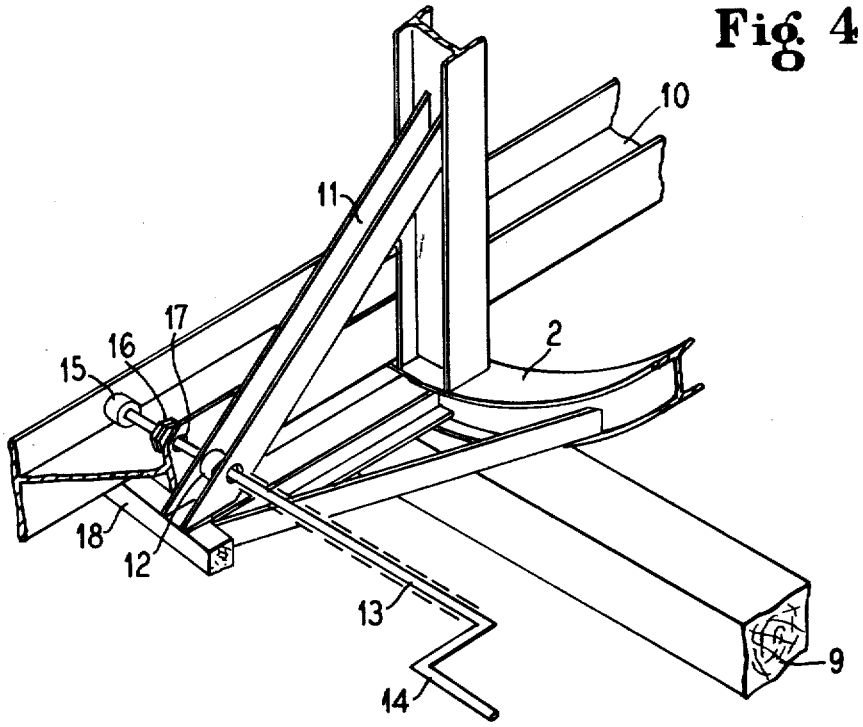
FIG. 4 is a partial, close-up, enlarged, isometric view of the withdrawal device of the casting table of the present invention.
Figure 5:
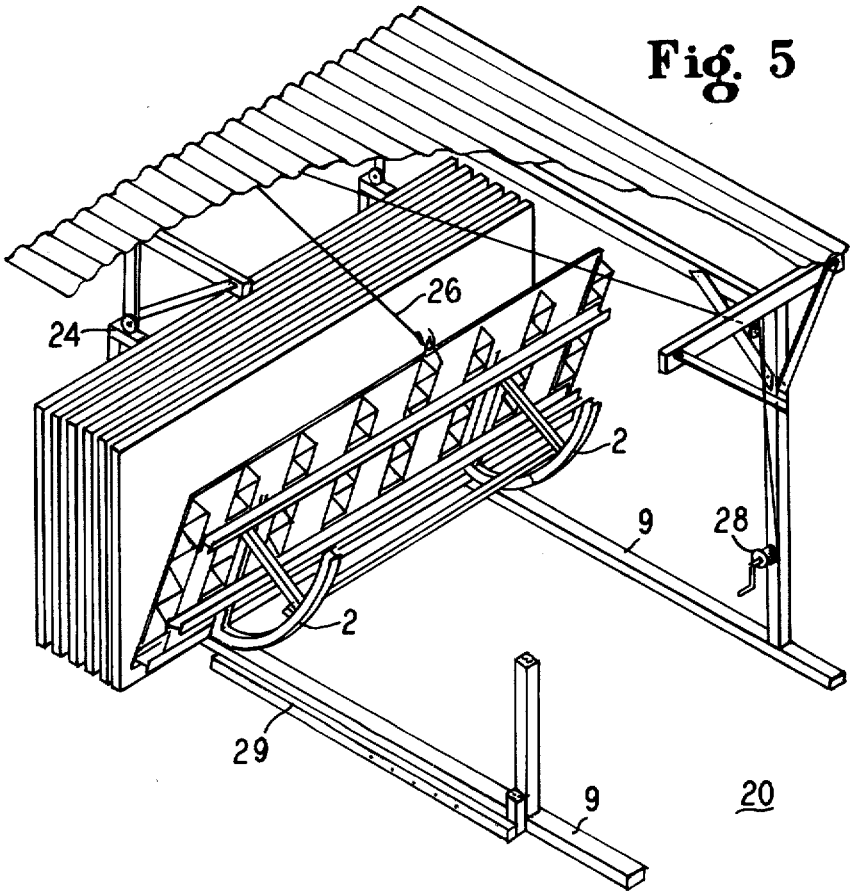
FIG. 5 is a fragmentary, isometric view of the movable shed with the casting table in a vertical position.

FIG. 4 shows a detail of the casting table in raised position. On the underside of the understructures 2 there is in each case a tripod 11 attached. A bushing 12 provided with an internal thread is welded onto the tripod. A strong threaded rod 13 having a turning device 14 is screwed through the bushing 12. The threaded rod projects through a hole 17 in support 10 to reach into a threadless bushing 15 similarly welded onto support 10. There is a fixture 16, which for example can consist of two checked nuts, on the threaded rod 13. In addition there is a claw 18 attached to the tripod.

The casting table 1 is accommodated in a movable shed 20. This can be of simple wooden beam construction or of a steel pipe construction with an asbestos cement or some other covering. It stands on rubber-tired rollers 21 which rest on the already-completed concrete components. A supporting framework 23, to which the already-completed walls are attached in vertical position, is attached to the crane beams 9. These frameworks have supports 24 on which the rollers 21 stand before the first walls have been completed.

On the other side the shed 20 stands on rollers 22 which run on the crane beams 9. The shed can be attached by means of clamps or other devices to the crane beams 9 and the framework 23, or to the already-completed walls, so that it cannot be lifted by wind forces.

The lateral bounding framework is attached to the large-area mold 8. It can consist of a few rigid metal girders which are screwed on and can therefore be positioned with high accuracy. In the region of the understructures 2 the bounding framework consists of short lengths of squared timber 19 which are inserted.

The walls are so produced that they are first of all concreted on the horizontally-positioned table 1. After a short hardening time they are raised by rolling back the table on the runners of the understructures 2. If the curvature of the runners is chosen to be circular and such that the centre of curvature lies at the centre of gravity of the concrete elements, only the centre of gravity of the casting table is lifted during erection. A relatively small restoring moment occurs in each case during lifting and lowering. Since the position of the centre of gravity of the casting table can be influenced by constructive measures, the curvature of the runners and the position of the centre of gravity can be optimized accordingly. In particular, for reasons of stability, a restoring moment is maintained. In order to forcefully control the erection process, the table 1 has a hook 25 attached to it, in which a cable 26 is hung by means of an eye. The cable 26 runs over rollers 27 to a winch 28 being provided with a ratchet. By turning the winch the wall can now be raised and the table, having been drawn off from the wall, can be lowered again. The curvature of the runners can now be optimized so that the forces in cable 26 are constant and minimal. The resulting sled shape is not exactly circular, and an instantaneous centre curve is formed by the centre of curvature.

The claws 18 prevent the pre-cast wall from slipping prematurely off the casting table during the erection process. When the wall has been lifted into vertical position, it stands on the crane beams 9. The lengths of timber 19 used here as lateral bounding framework and which are not removed, prevent any escape of the still-fresh concrete.

The mold framework must now be drawn off from the wall. Since the concrete is still fresh, there is a danger of its escaping. A device is therefore necessary which distributes the forces arising during withdrawal over as large a surface area as possible. This device is provided by support 10. By turning the threaded rod 13 to the right, it presses against the support 10. Since this represents the lowest part of the mold framework, it presses against the wall over its whole length, thus pulling the framework off. The support must be sufficiently rigid as to ensure that the bending occurring in it is small enough to exclude cracks in the concrete. It serves no purpose however, to further increase the rigidity, since in so doing the forces necessary for the withdrawal are higher because the withdrawal process spreads more quickly over the whole molding surface.

When the mold framework has been drawn off, the table 1 can be immediately brought into the new position by turning the threaded rod further until the casting table has moved far enough away from the wall to make room for the next wall. If the threaded rod 13 is now turned to the left, the fixtures 16 press against the support and draw it away from the wall. Since the ends of the threaded rod project into the bushings 15, it does not tip. By further turning to the left the table is pulled back to its starting position. The casting table is now lowered into the horizontal position and the next wall or ceiling respectively can be concreted.

The movable shed 20 is chosen large enough to accommodate several walls, for example, a week's production. This guarantees that the still-fresh concrete walls are not immediately exposed to the weather.

In the case of the rollers 22 there is in each case a rod 29 connected rigidly to the shed 20. The rods 29 run parallel to the crane beams 9. When the casting table is in raised position, the claws 18 come in contact with the ends of the rods 29. When the casting table is pushed back with the help of the withdrawal device, the claws 18 press against the rods 29 and push the shed back. The rod is provided with horizontal holes 30 and cylinder holes 31 in the crane beams 9. This enables the crane frame and the housing to be secured in a fixed position by bolts 32. The distance between these holes corresponds to the breadth of space required for each concrete element. There are cylinder holes 31 in the crane beams, occurring at intervals which are a multiple (e.g. $\times 6$) of the hole intervals in the rod 29. The cylinder holes in the rod and in the crane beams are in alignment. The casting table is now pushed back until the cylinder holes match and a bolt 32 is pushed in. In this way undesired lateral displacements of the shed 20 are prevented. This is necessary since during the erection process by the cable 26 horizontal forces are exercised on the shed. Furthermore the bolt secures the shed on the side of the rollers 22 against any lifting and an exact measure of how far the casting table must be pushed back in each case is achieved. The rollers 22 and/or 21 can possibly be omitted since with the help of the withdrawal device large forces can be exercised. The shed is then moved by sliding on its bearing surfaces. At the side of the erected walls the shed can be secured against lifting by hanging the cable 26 on the underside of the last wall and drawing it tight with the winch 28.

For the manufacture of ribbed walls, inserts 33 are laid on after the casting of the continuously smooth wall component. These inserts consist preferably of sheets 34 which are bent to a trapezoidal-shaped hollow body. The hollow body is filled with hard-foam plates and covered at the top with sheets 35, these being screwed to the sheets 34 to prevent any displacement. Light insert pieces of high rigidity result. These inserts 33 are connected to a continuous grill 40 by means of two beams, preferably wooden pin girders, 36. The grill is hung from the ceiling of the shed 20. Rollers 37, 38 and 39 are attached to the ceiling of the shed 20 above one corner of the casting table as well as above the centre of each of the understructures 2. When the grill 40 is to be removed after concreting of the column, the cable 26 is first passed over the roller 37 and hung onto a corner of the grill 40. With the help of the winch 28 a corner of the grill is raised and loosened from the groined ceiling. The cable is now hung around the roller 38. The roller 38 is the roller lying nearer to the roller 37. Since the grill has already been loosened here the one side of the grill can now be raised to the ceiling and hung from here. The cable can now be hung around roller 39 and the other side of the grillage can be raised and hung.

The overarches of the pin girders 36 are constructed as approx. 50 cm broad planks, so that they can be used as wheelbarrow tracks. The shed is high enough to provide standing height above the wheelbarrow tracks. The concrete is mixed with the help of a mixer having a hoist. The hoist is high enough for the wheelbarrow to be filled at the level of the wheelbarrow tracks. The only further requirement is to lay wheelbarrow tracks from the mixer to the tracks 41 so as to enable the elements to be concreted. If the tracks 41 are connected with one another in each case at the end of the grillage, a rotary working can be set up which guarantees a frictionless concreting operation.

Although various modifications might be suggested by those skilled in the art, it should be understood that I wish to embody within the scope of the patent warranted hereon all such modifications as reasonably and properly come within the scope of my contribution to the art.

I claim:

1. Apparatus for casting plate-like concrete wall elements comprising a casting table, a wide area mold affixed thereto, said casting table being supported by a pair of curved runners, said casting table being stable when said wide area mold is in a horizontal position and rockable upon said pair of curved runners to place said wide area mold in substantially a vertical position, removal means operable to separate said wide area mold from said concrete wall element when said wall element is in the vertical position, said removal means including a member forming the lowest part of said wide area mold when said wide area mold is in a vertical position.

2. The apparatus according to claim 1, wherein said removal means comprises at least one threaded rod having a crank handle at its outer end carried in a threaded bushing on said table.

3. The apparatus according to claim 2, in which said threaded rod is operable to slide said casting table immediately back into position to cast another of said plate-like elements.

4. The apparatus according to claim 3, in which said casting table has a pair of supporting claws operable to prevent said plate-like concrete element from sliding prematurely off of said wide area mold during the period of time said casting table is being moved to a vertical position.

5. The apparatus according to claim 4, in which a base frame is provided for supporting said casting table and in which an all encompassing shed is movably mounted on rollers on said part of said base frame which supports said casting table.

6. The apparatus according to claim 5, wherein said threaded rod is further operable to move said shed the same amount said table is moved.

7. The apparatus according to claim 6, in which said movable shed has a cable affixed to a winch means for raising said casting table to a vertical position.

8. The apparatus according to claim 7 further comprising a plurality of interconnected mold inserts operable, in conjunction with said casting table, for casting ribbed walls.

9. An apparatus for casting concrete wall sections comprising:

a movable shed movably mounted on track means;

a casting table movably mounted within said shed on said track means;

said casting table being mounted on a pair of curved runners and having a wide area mold affixed thereto;

said casting table being stable when said wide area mold lies in a horizontal position and being raisable to a vertical position by being rocked on said curved runners;

removal means for separating said casting table laterally a predetermined distance from said concrete wall sections after casting;

said removal means being further operable to move said shed laterally a distance corresponding to the displacement of said casting table.

10. The apparatus according to claim 9 including a plurality of interconnected mold inserts operable in conjunction with said wide area mold, and including means operable to extract said plurality of interconnected mold inserts from said concrete wall sections prior to raising said casting table to a vertical position.

* * * * *